US007396146B2

(12) United States Patent
Wang

(10) Patent No.: US 7,396,146 B2
(45) Date of Patent: Jul. 8, 2008

(54) HEAT DISSIPATING LED SIGNAL LAMP SOURCE STRUCTURE

(75) Inventor: Pei-Choa Wang, Gueishan Township, Taoyuan County (TW)

(73) Assignee: Augux Co., Ltd., Taoyuan County (TW)

( * ) Notice: Subject to any disclaimer, the term of this patent is extended or adjusted under 35 U.S.C. 154(b) by 62 days.

(21) Appl. No.: 11/463,456

(22) Filed: Aug. 9, 2006

(65) Prior Publication Data

US 2008/0037255 A1 Feb. 14, 2008

(51) Int. Cl.
*F21V 29/00* (2006.01)

(52) U.S. Cl. ..... 362/294; 362/373

(58) Field of Classification Search ..... 362/96, 362/234, 294, 373, 800; 313/11
See application file for complete search history.

(56) References Cited

U.S. PATENT DOCUMENTS 7,144,140 B2 * 12/2006 Sun et al. ..... 362/373
2007/0236935 A1 * 10/2007 Wang ..... 362/294

* cited by examiner

*Primary Examiner*—John A Ward

(57) ABSTRACT

A heat dissipating LED signal lamp emitting structure includes an isothermal board, a light emitting unit on the isothermal board, a heat conducting cylinder connected to the bottom of the isothermal board, a heat dissipating body around the periphery of the heat conducting cylinder and comprised of heat sinks, a circular cover body above the isothermal board for covering the isothermal board, a reflecting groove at the center of the cover body for passing through the light emitting unit, and a transparent lid on the cover body for covering the light emitting unit. With the heat dissipating effect of the heat dissipating body, the operating heat produced by the light emitting unit can be dissipated to the outside. The invention not only uses a single light emitting unit as a signal lamp emitting source, but also enhances the light emitting efficiency and the life expectancy of the light emitting unit.

6 Claims, 6 Drawing Sheets

HEAT DISSIPATING LED SIGNAL LAMP SOURCE STRUCTURE

BACKGROUND OF THE INVENTION

1. Field of the Invention

The present invention relates to a signal lamp, and more particularly to a signal lamp structure that uses a light emitting diode as a light source.

2. Description of Prior Art

In general, a signal lamp is installed at an intersection of roads for directing pedestrians to walk or stop at a specific time, so as to assure the traffic flow and safety, maintain the order of traffics, and even lower the chance of traffic jams and accidents.

A common traffic signal lamp is the three-color traffic signal lamp that reminds pedestrians when to walk or stop by means of three colors: red, yellow and green. A traditional three-color signal lamp uses white bulbs to work with red, yellow and green lens or color bulbs that can emit red, yellow and green lights, and the signal lamp is covered and protected by a lampshade, so as to form a light emitting structure of the signal lamp. However, the traditional signal lamp structure that emits light by bulbs may be sheltered by sunlight in daytime easily or affected by rain in a rainy day, and thus weather conditions may directly affect a pedestrian's determination of the color of the signal lamp, and the chance for the occurrence of accidents may be increased.

To overcome the shortcomings of the traditional bulbs, a prior art uses a light emitting diode (LED) to substitute the traditional bulb as the light source of the signal lamp. Since the light source of light emitting diodes has the advantages of consuming less electric power and providing a high light emitting efficiency and a long life expectancy. As technology advances rapidly, the LED is much brighter than ever and thus the light source of light emitting diodes can be used for substituting the traditional bulb. Such arrangement not only saves power consumption and long time of use, but also provides high recognition in different weather conditions and greatly reduces pedestrians' misjudgment and the chance of occurrence of accidents.

In the present existing LED signal lamp structures, most light emitting structures require 125 to 188 pieces of light emitting diodes. Since the light emitting diodes will produce a considerable quantity of heat during their operations and general signal lamps usually do not come with a heat dissipating structure for the light emitting diodes, therefore a great deal of heat will be accumulated in the signal lamp structure. As a result, the temperature in the signal lamp will rise and may cause a short circuit of the light emitting diodes, and the signal lamp will become dimmer or inoperable, which will directly affect pedestrians' judgment and endanger traffic safety. Although a prior art structure uses an aluminum board for dissipating the heat produced by a plurality of light emitting diodes, the heat dissipating effect is very limited and unable to enhance the heat dissipation of the signal lamp, which becomes a blemish of the LED signal lamp structure.

SUMMARY OF THE INVENTION

In view of the foregoing shortcomings of the prior art, the inventor of the present invention based on years of experience in the related industry to conduct experiments and modifications, and finally designed a heat dissipating LED signal lamp emitting structure in accordance with the present invention.

Therefore, the present invention is to provide an LED signal lamp emitting source structure having a heat dissipating structure that uses a single light emitting unit as the signal lamp emitting source, and the light emitting unit has a heat dissipating structure disposed at the periphery of the light emitting unit to dissipate the heat produced by the light emitting unit to the outside, Besides substituting a plurality of traditional light emitting units by a single light emitting unit, the present invention also provides a design of a heat dissipating structure to enhance the light emitting efficiency and the life expectancy of the light emitting unit.

The present invention provides an LED signal lamp emitting source structure that comprises an isothermal board being a highly thermal conducting disc, a light emitting unit disposed on the isothermal board, a hollow heat conducting cylinder connected to the bottom of the isothermal board, a heat dissipating body disposed around the periphery of the heat conducting cylinder and comprised of a plurality of heat sinks, a circular cover body disposed above the isothermal board for covering the isothermal board, a reflecting groove disposed at the center of the cover body for passing through the light emitting unit, and a transparent lid disposed on the cover body for covering the light emitting unit. With the heat dissipating effect of the heat dissipating body, the operating heat produced by the light emitting unit can be dissipated to the outside. The invention not only uses a single light emitting unit as a signal lamp emitting source, but also enhances the light emitting efficiency and the life expectancy of the light emitting unit.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings. However, the drawings are provided for reference and illustration only and are not intended for limiting the scope of the invention.

Figure 1:
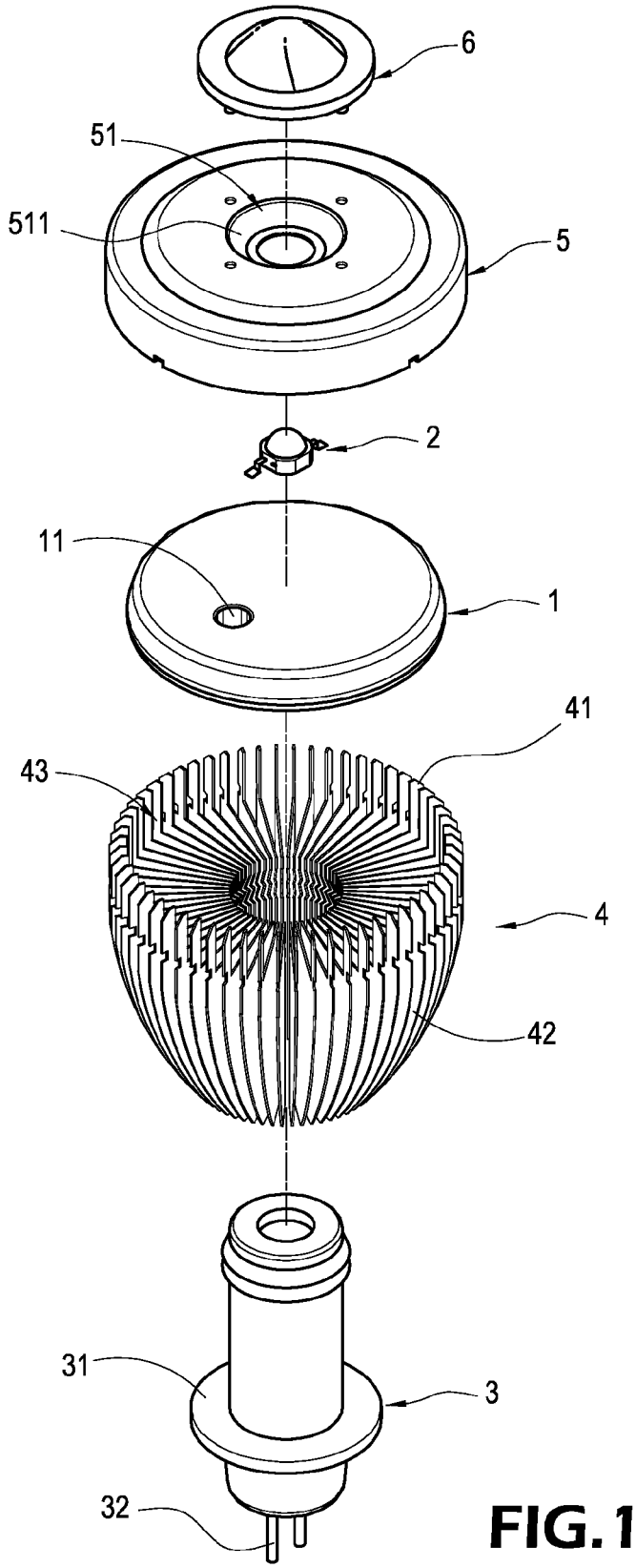
FIG. 1 is an exploded view of the present invention.
Figure 2:
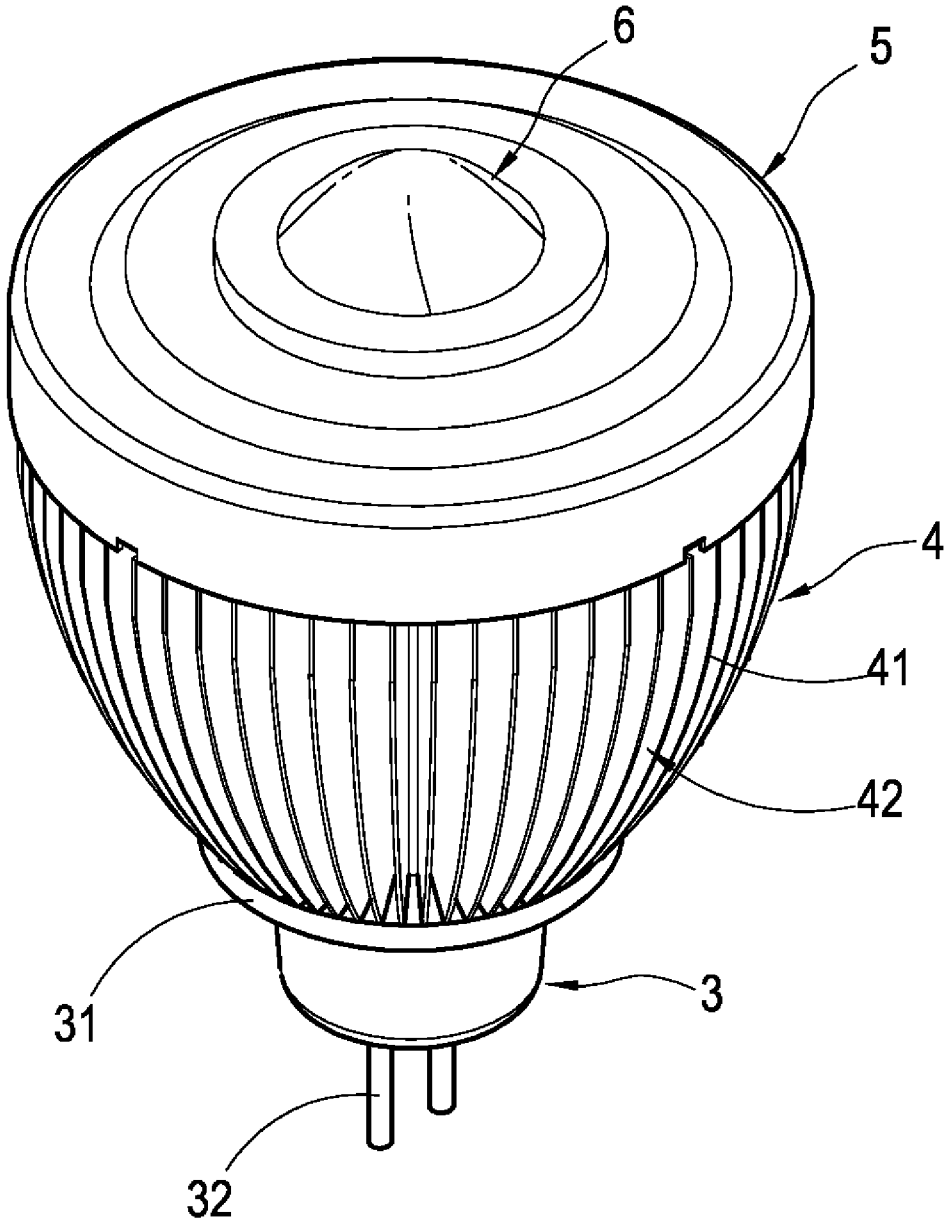
FIG. 2 is a perspective view of the present invention.
Figure 3:
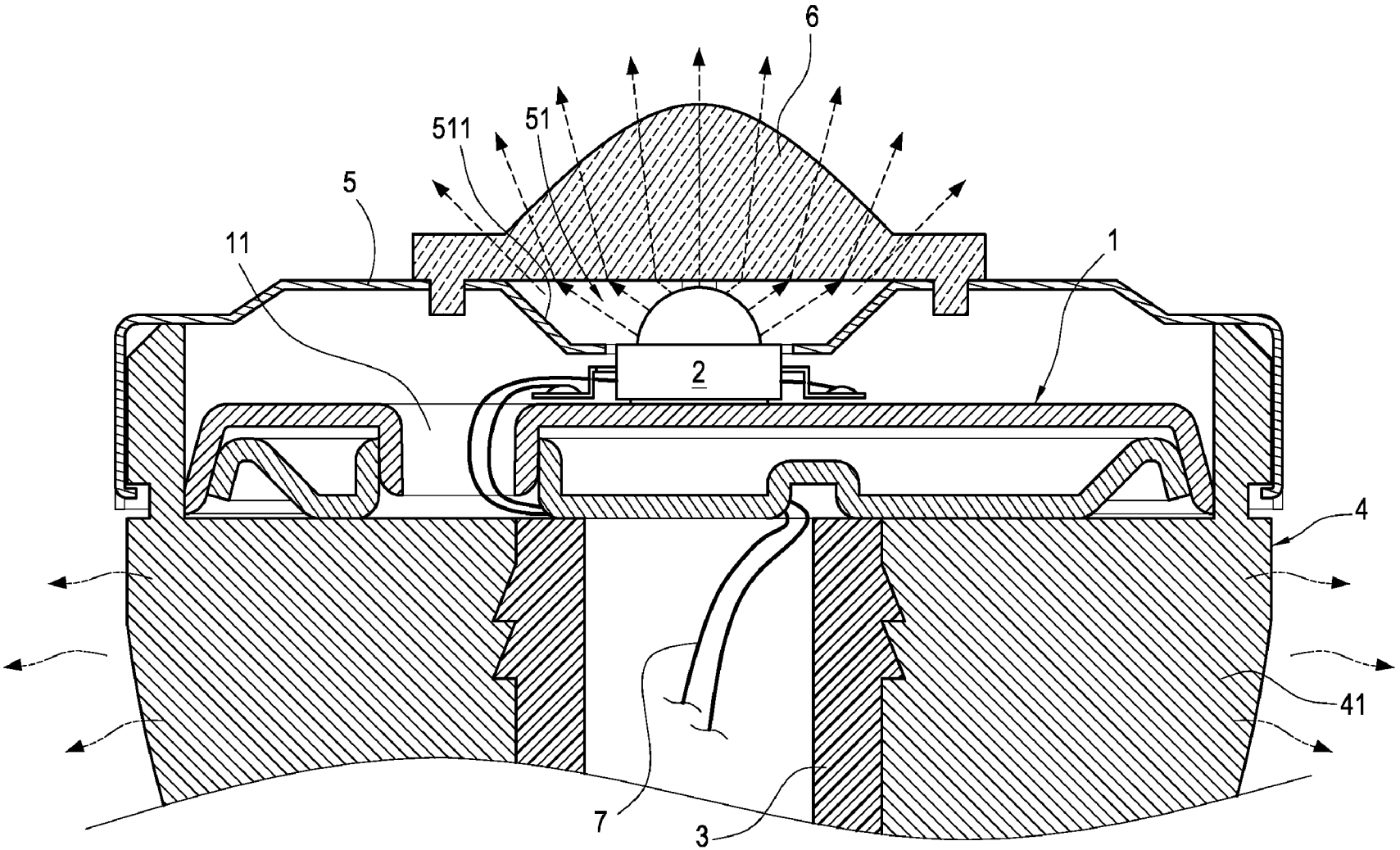
FIG. 3 is a cross-sectional view of the operation of the present invention.

Referring to FIGS. 1 and 2 for a schematic view and a perspective view of the present invention, a signal lamp structure of the invention comprises an isothermal board 1, a light emitting element 2, a heat conducting cylinder 3, a heat dissipating body 4, a cover body 5, and a lid 6, wherein the isothermal board 1 of this embodiment is substantially in the shape of a circular disc, and the isothermal board 1 is made of a highly thermal conducting material. The isothermal board 1 has a through hole 11, and the light emitting unit 2 is disposed on the isothermal board 1, and the light emitting unit 1 of this embodiment is a light emitting diode, and the light emitting element 2 is electrically coupled to a conducting wire 7 (as shown in FIG. 3) and passed through the through hole 11 of the isothermal board 1 to connect to a power supply externally. The bottom of the isothermal board 1 is connected to a hollow heat conducting cylinder 3 for absorbing the heat conducted from the isothermal board 1, and the lower end of the heat conducting cylinder 3 has a circular protruding board 31, and the lower end of the heat conducting cylinder 31 has a plurality of electrode plugs 32, and the interior of the heat conducting cylinder 3 is provided for passing the conducting wire 7 and electrically connecting the electrode plugs 32 (which is a prior art and thus will not be described here). The heat dissipating body 4 is comprised of a plurality of heat sinks 41 and disposed around the periphery of the heat conducting cylinder 3, and a heat dissipating gap 42 is formed between any two heat sinks 41, and the bottom of a plurality of heat sinks 41 is connected to the protruding board 31 of the heat conducting cylinder 3. After the plurality of heat sinks 41 are assembled to form the heat dissipating body 4, the top of the heat dissipating body 4 forms a circular sunken space 43 for containing the isothermal board 1 and attaching the periphery of the isothermal board 1. The cover body 5 is installed above the isothermal board 1, and the cover body 5 is a hollow disc for covering the isothermal board 1 inside the cover body 5, and the middle of the cover body 5 has a reflecting groove 51 corresponding to the position of the light emitting unit 2 precisely. In the meantime, the light emitting unit 2 is contained in the reflecting groove 51, and the periphery of the reflecting groove 51 has a reflecting surface 511 for reflecting the light produced by the light emitting unit 2. Finally, the lid 6 is installed on the cover body 5, while the light emitting unit 2 is covered in the lid 6. The lid 6 is a transparent cover for letting the light produced by the light emitting unit 2 pass through the lid 6 to the outside. FIG. 2 shows an assembly of the invention.

Referring to FIG. 3 for a cross-sectional view of an application of the present invention, the light emitting unit 2 disposed on the isothermal board 1 is electrically connected to the conducting wire 7 for supplying electric power for the operation, after the LED signal lamp of the invention is assembled. The light produced by the light emitting unit 2 is passed through the lid 6 to the outside directly or reflected from the reflecting surface 511 at the periphery of the light emitting unit 2 out of the lid 6 indirectly, so as to form a light source of the signal lamp structure, and the operating heat produced by the light emitting unit 2 is absorbed by the isothermal board 1 to lower the heat accumulation effect produced by the light emitting unit 2, and then the isothermal board 1 conducts the absorbed operating heat onto the heat conducting cylinder 3 and dissipates the heat to the heat dissipating body 4 connected to the heat conducting cylinder 3, or the isothermal board 1 directly conducts the operating heat to the periphery which is attached to the plurality of heat sinks 41 for the heat dissipation, so as to enhance the light emitting efficiency and the life expectancy of the light emitting unit 2.

Figure 4:
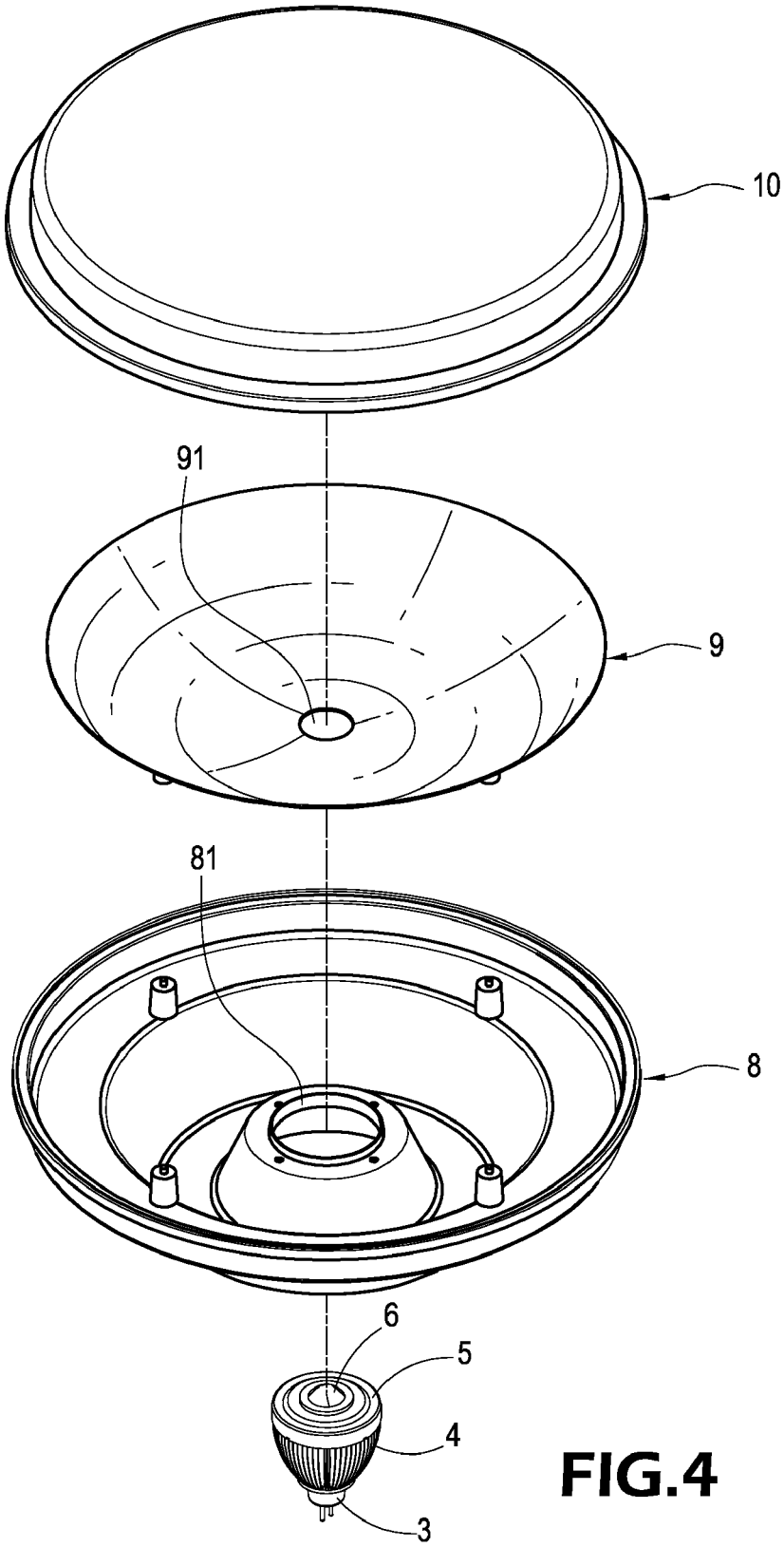
FIG. 4 is an exploded view of an assembly of the present invention.
Figure 5:
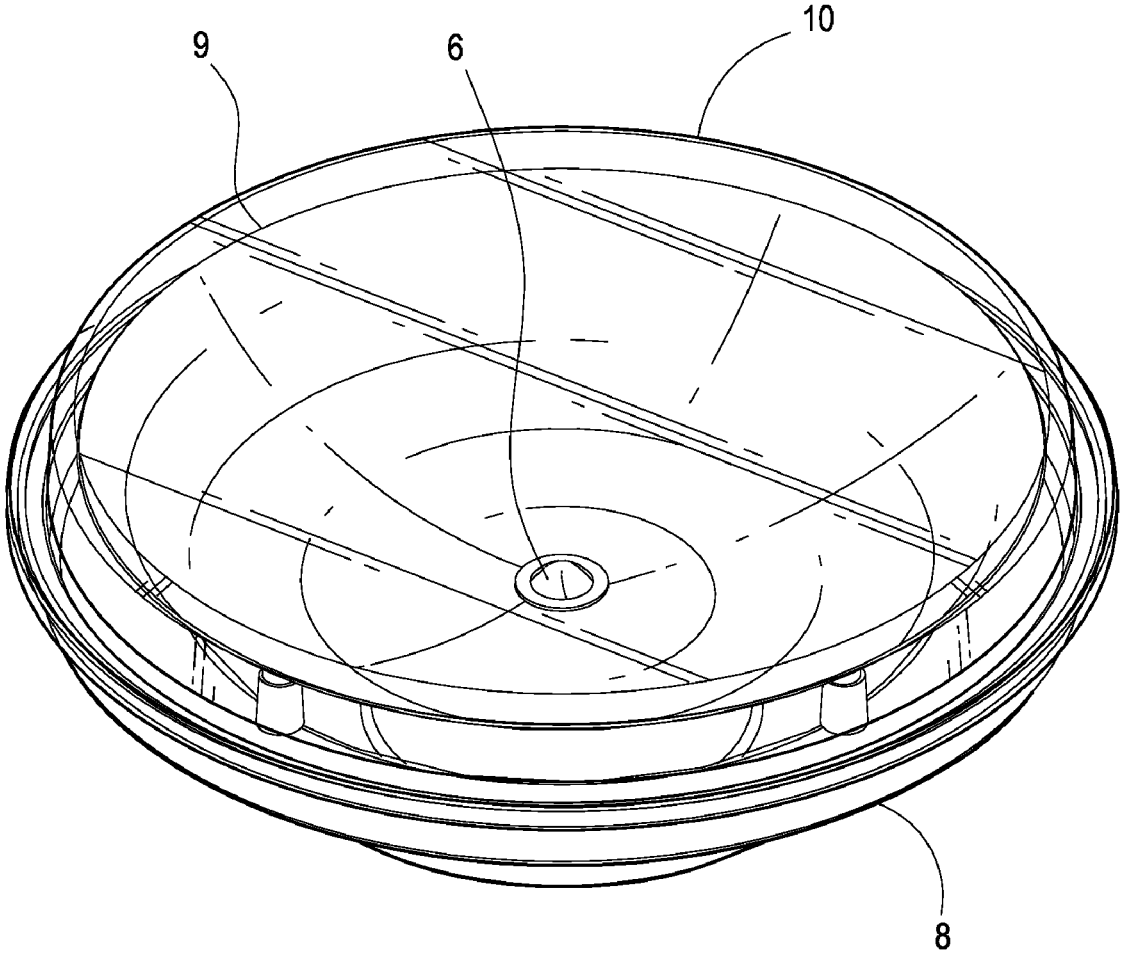
FIG. 5 is a perspective view of an assembly of the present invention.

Referring to FIGS. 4 and 5 for an exploded view and a perspective view of an assembly of the invention, the LED signal lamp emitting source of the invention is set on the a lamp holder 8, and the lamp holder 8 is substantially in the shape of a disc, and the center of the lamp holder 8 has a containing hole 81 for installing the LED signal lamp emitting source. In the meantime, the lamp holder 8 is connected to a reflecting board 9, and the center of the reflecting board 9 also has a penetrating groove 91 corresponding to the position of the containing hole 81 of the lamp holder 8. Finally, the lamp holder 8 is connected to a corresponding transparent lampshade 10 for covering the reflecting board 9 and the LED signal lamp emitting source inside the lamp holder 8. FIG. 5 shows the assembly of the present invention.

Figure 6:
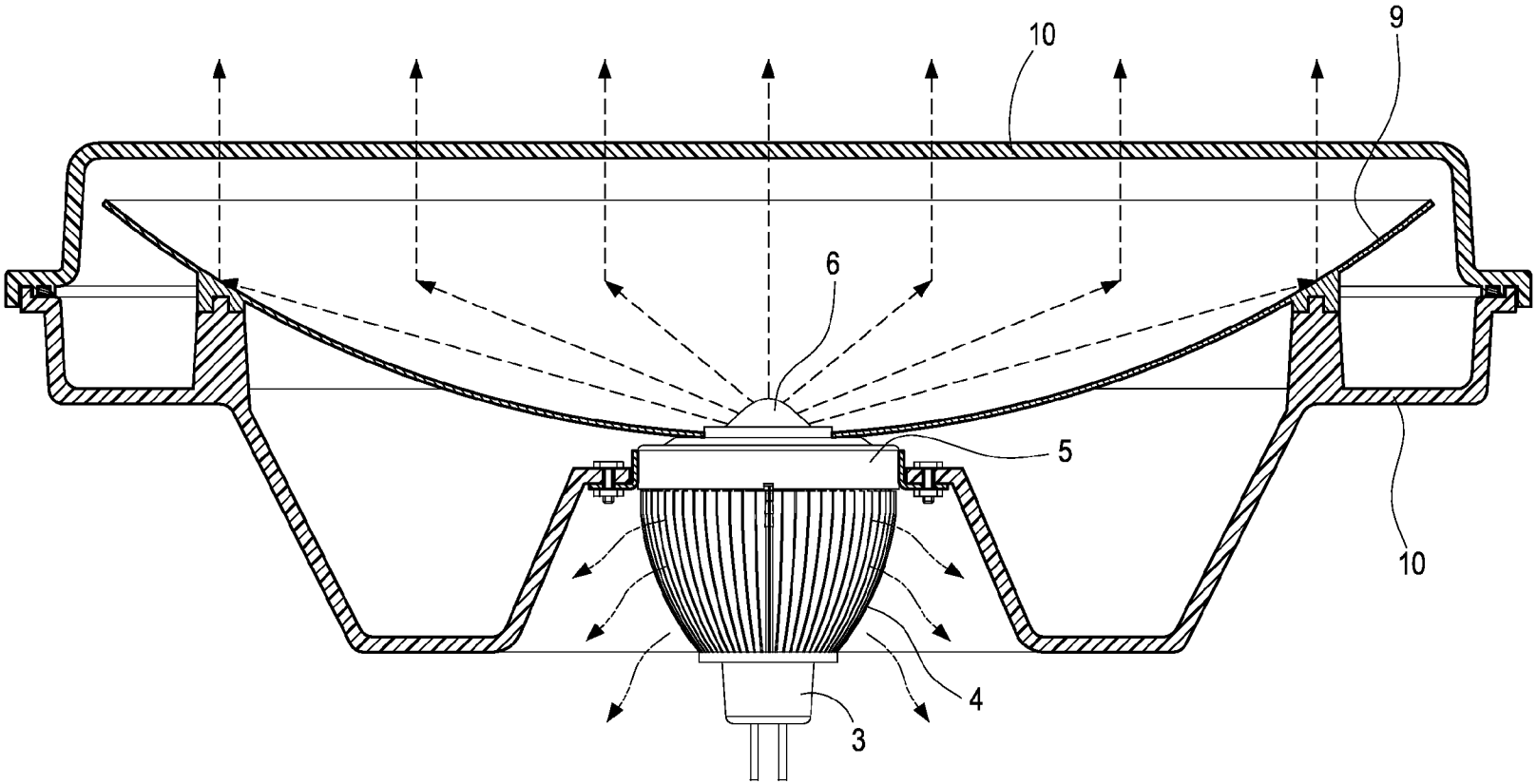
FIG. 6 is a cross-sectional view of operating an assembly of the present invention.

Referring to FIG. 6 for a cross-sectional view of an operation of the present invention, the light produced by the LED signal lamp emitting source forms a light directly through the lampshade 10. In the meantime, the light produced by the LED signal lamp emitting source is refracted from the reflecting board 9 to the outside for enhancing the brightness of the light produced by the signal lamp, so that pedestrians can clearly recognize the signal lamp. Further, the operating heat produced by the LED signal lamp emitting source during the operation of the signal lamp is dissipated from the heat dissipating body 4 to assure the normal operation and the long life expectancy of the signal lamp.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A heat dissipating LED signal lamp emitting structure, comprising:

an isothermal board, made of a highly thermal conducting material;

a light emitting diode, attached on an upper side of the isothermal board;

a heat conducting cylinder, being a hollow body with an outer diameter not larger than that of the isothermal board, axially attached on a lower side of the isothermal board, having an electrode plug disposed on a lower distal surface thereof and electrically coupled to the light emitting unit;

a heat dissipating body, having a receiving hole for receiving the heat conducting cylinder;

a cover body, coupled to the upper side of the isothermal board, and having a reflecting groove for accommodating the light emitting unit; and a lid, disposed on the cover body, for covering the light emitting unit inside the lid.

2. The heat dissipating LED signal lamp emitting structure of claim 1, wherein the isothermal board further includes a through hole.

3. The heat dissipating LED signal lamp emitting structure of claim 1, wherein the heat conducting cylinder has a circular protruding board disposed on an cylindrical surface thereof against the heat dissipating body.

4. The heat dissipating LED signal lamp emitting structure of claim 1, wherein the heat dissipating body includes a plurality of heat sink fins.

5. The heat dissipating LED signal lamp emitting structure of claim 1, wherein the heat dissipating body forms a sunken space at top thereof, for accommodating the isothermal board to contact each other.

6. The heat dissipating LE 5 D signal lamp emitting structure of claim 1, wherein the reflecting groove further has a reflecting surface disposed at a periphery of the reflecting groove.

* * * * *